United States Patent [19]

Iwasa et al.

[11] 4,415,765

[45] Nov. 15, 1983

[54] WIRE HARNESS

[75] Inventors: Tatsuya Iwasa; Takayuki Inoue; Noriyuki Mizuta, all of Hyogo, Japan

[73] Assignee: Mitsubishi Denki Kabushiki Kaisha, Tokyo, Japan

[21] Appl. No.: 261,161

[22] PCT Filed: Oct. 31, 1980

[86] PCT No.: PCT/JP80/00272

§ 371 Date: Apr. 30, 1981

§ 102(e) Date: Apr. 30, 1981

[87] PCT Pub. No.: WO81/01343

PCT Pub. Date: May 14, 1981

[30] Foreign Application Priority Data

| | | | |
|---|---|---|---|
| Nov. 2, 1979 | [JP] | Japan | 54-142567 |
| Nov. 8, 1979 | [JP] | Japan | 54-145208 |
| Nov. 26, 1979 | [JP] | Japan | 54-153181 |

[51] Int. Cl.[3] ..... H01B 7/00

[52] U.S. Cl. ..... 174/72 A; 40/316; 174/112; 206/330; 206/344

[58] Field of Search ..... 174/72 A, 72 TR, 112, 174/117 F, 117 M, 117 A; 29/755, 872; 40/316; 100/1; 179/98; 206/330, 344; 339/148; 361/428

[56] References Cited

U.S. PATENT DOCUMENTS

| | | | |
|---|---|---|---|
| 2,982,595 | 5/1961 | Rogers, Jr. | 206/344 X |
| 3,346,688 | 10/1967 | Fields | 174/72 A X |
| 3,459,878 | 8/1969 | Gressitt et al. | 29/872 X |
| 3,495,025 | 2/1970 | Ross | 29/872 X |
| 3,994,090 | 11/1976 | Wheeler | 174/112 X |

FOREIGN PATENT DOCUMENTS

| | | | |
|---|---|---|---|
| 580898 | 9/1924 | France | 174/117 F |
| 1271176 | 7/1961 | France | 174/72 A |
| 555745 | 9/1943 | United Kingdom | 174/72 A |

OTHER PUBLICATIONS

Neusser, H., "Wiring Harness", *IBM Technical Disclosure Bulletin,* vol. 18, No. 5, Oct. 1975, p. 1484.

Mass Assembled Cable-Connector Systems, (T & B/Ansley Corporation), Catalogue pp. 4–6; 75–77.

Automatic Discrete Wire Harness Mass Termination I.D. Connector Systems, (Insulation/Circuits), Jun. 1979, pp. 33–36.

Cable Assembly and Fastening Technique, (Design Engineering), Mar. 1979, pp. 84, 85 and 87.

*Primary Examiner*—Laramie E. Askin

*Attorney, Agent, or Firm*—Oblon, Fisher, Spivak, McClelland & Maier

[57] ABSTRACT

A plurality of connecting wires to be connected to separate devices are arranged regularly and fastened with a string at the front end, the intermediate end and the rear end corresponding to the position of the respective device so as to provide a flat structure including the fastening points in connection with the arrangement in order and the position of each end of the connecting wires so that the wiring can be easily attained to improve productivity; the reading of wiring diagram in the wiring operation is needless by connecting a data card; the flat structure facilitates employment of machines and the combination with a computer allows a fully automatic system. When the connecting wires are bundled, the increase of occupied sectional area is prevented and the occupied sectional area is substantially the same as that of the conventional one. The present invention is suited to the wiring of electric control devices.

2 Claims, 20 Drawing Figures

FIG. 17
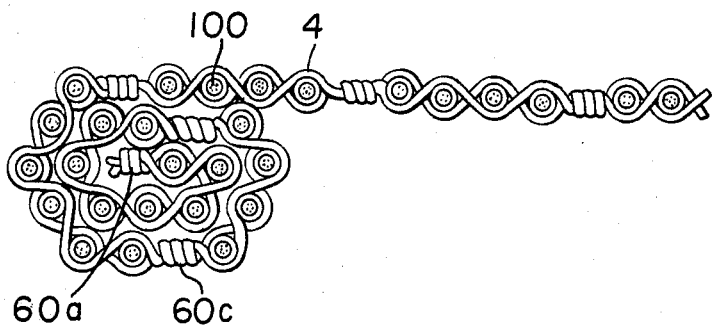
FIG. 18
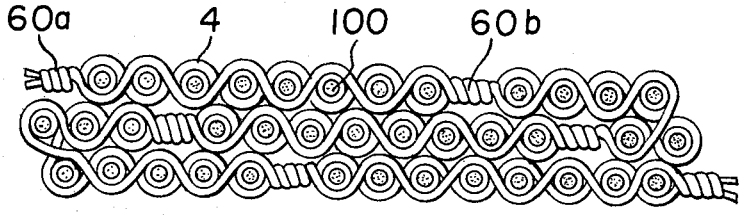
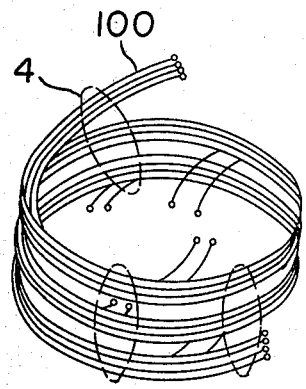
FIG. 19(a)
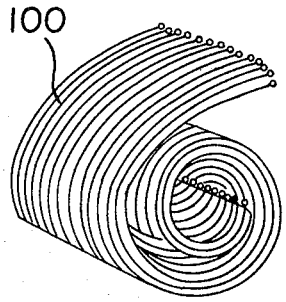
FIG. 19(b)

WIRE HARNESS

BACKGROUND OF THE INVENTION

1. Field of the Invention

The present invention relates to a wire harness for holding a number of connecting wires used for wiring electric control apparatuses and devices.

2. Description of the Prior Art

Heretofore, wire harnesses have been used to combine a plurality of connecting wires to be connected with electric control apparatuses into a group of connecting wires and the connecting wires often take a shape as shown in FIG. 1. In FIG. 1, the reference numeral (100) designates as a whole a connecting wire and (1) designates an electric wire. Both ends of the electric wire are connected to solderless terminals (2A), (2B). Data of wire distribution (3A), (3B) are provided near both ends of the electric wire (1). The data of wire distribution (3A), (3B) can be the line number and the device number and so on which are shown at both ends of the electric wire (1).

FIG. 2 is a diagram showing a plurality of the connecting wires shown in FIG. 1 which are combined by binding members and FIG. 3 is an end surface view of FIG. 2.

A general way for connecting the connecting wire (100) between devices held in an electric control panel is to cut the connecting wire in a required length; to provide at both the ends data of wire distribution (3A), (3B) described above, that is, line numbers, the positions and numbers of the devices, terminal number or other data of wiring and connecting; and secure solderless terminals (2A), (2B); thus the shape of the connecting wire shown in FIG. 1 is completed. The connecting wire (100) is normally prepared prior to the wiring operation to improve the efficiency of the wiring operation.

The connecting wires (100) thus previously prepared are fed to the next process with a predetermined number for each device or single unit. In this case, a number of the connecting wires (100) are combined together by a binding member (4) into the shape shown in FIGS. 2 and 3 to be used as a wire harness (101). FIG. 4 shows another embodiment of one unit combined by the binding member (4) wherein the connecting wires (100) in the unit are connected to each terminal in the distribution panel or apparatus.

In the conventional wire harness, workers' skill is required to determine the order of the wiring operation when it is applied to each device, this resulting in a poor processability. In addition, in the wiring operation to the devices, it is necessary to take up the requisite connecting wires in the wire harness one by one. This presents difficulty in finding out the data of wire distribution marked in the connecting wire of the central portion of the harness, thereby resulting in a poor processability and an erroneous wiring operation. Further, when the connecting wires are combined into one for each control unit, the diameter of a bundle is too great or when combined into one for each device, the number of bundles so increases that there is difficulty in transportation and maintenance and the determination of the order of the wiring operation is impossible. Because of insufficient flexibility of the connecting wires except when a harness is formed of the same kind of connecting wires, the connecting wires cannot be easily put into position, the bundling operation is poor and mechanization cannot be easily applied.

SUMMARY OF THE INVENTION

The object of the present invention is to overcome the disadvantages of the conventional wire harness and to resolve the trouble of wiring operation caused in the conventional wiring work using a wire harness fabricated by previously prepared connecting wires.

Another object of the present invention is to provide a wire harness which facilitates employment of a machine to fabricate it by binding the connecting wires one by one.

Another object of the present invention is to provide a wire harness in which the connecting wires previously prepared are prepared and arranged side-by-side in the order of wiring and are held independently by binding members.

Another object of the present invention is to provide a wire harness which improves the processability of the wiring operation and eliminates erroneous wiring operation. The present invention is to provide a wire harness characterized in that connecting wires previously prepared are prepared in the order of the wiring operation, the connecting wires are arranged side-by-side in that order on a paper tape each with a space and an adhesive tape is applied on the paper tape to keep the connecting wires rigid by adhesion.

In accordance with a wire harness of the present invention, connecting wires which are to be connected between apparatuses and devices such as electric control panels, distribution panels and boards are cut in a predetermined length for each kind (material), size and color in the previous step; data of wire distribution such as line numbers are applied to both ends; solderless terminals are secured at the ends and the connecting wires are arranged in the order of the wiring operation and marks are applied on each connecting wire which is to be connected between specified devices so that the connecting wires of the harness are cut at those portions. The harness provides advantages in that operators are free from having to find the connecting wire required for wiring for specified devices; are free from concern with the order of wiring in the connecting operation and can easily find the data of wire distribution provided at the ends of the connecting wires because they are arranged flat. Therefore, the wiring operation can be performed efficiently and without error even by non-skilled persons.

Because the connecting wires are independently combined, the tangle of each wire can be prevented and handling operation in transportation is easy. The connecting wires can be easily taken out when the binding member is not used. However, a harness with the binding member does not present any trouble because the binding member is made of an electrically insulating material. In addition, the connecting wires in a harnessed state eliminate or simplify a combining operation after the wiring operation.

The wire harness of the invention makes the employment of machines easy because of its having a flat structure and allows application of full automation system by the combination of a computer. The wire harness of the present invention, when combined, occupies the same sectional area as the conventional wire harness. The function of the harness is high.

BRIEF DESCRIPTION OF DRAWINGS

FIGS. 17 and 18 are respectively sectional views showing a bundled wire harness for easy transportation;

FIG. 19*a* is a schematic view showing the wire harness of the present invention when bundled into the state of FIG. 17; and FIG. 19*b* is a developed view of the wire harness of the present invention when bundled into the state of FIG. 18.

THE BEST EMBODIMENT OF THE INVENTION

Figure 5:
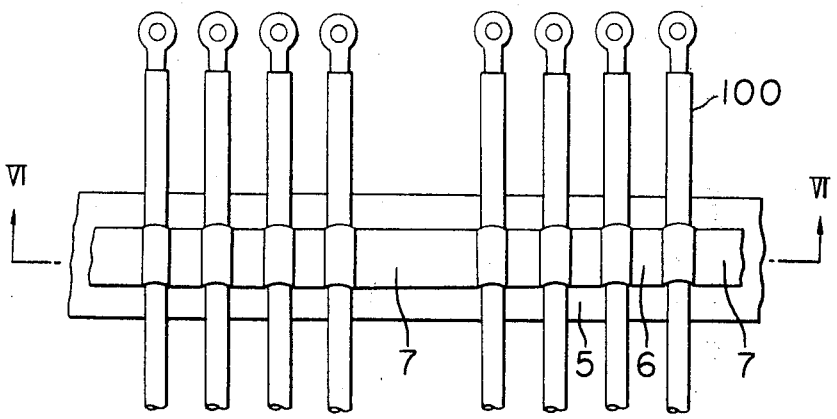
FIG. 5 is a front view showing a part of an embodiment of the wire harness of the present invention.

An embodiment of the present invention will be described with reference to drawings. As shown in FIG. 5, connecting wires (100) are arranged side-by-side and independently with a space in the order of preparation on a paper (5) and an adhesive tape (6) is put on the connecting wires (100) to make adhesive with the paper tape so that the connecting wires are held on the paper tape (5) by the adhesion of the adhesive tape. A space between adjacent groups of the connecting wires which compose each wiring unit, i.e. each wiring unit is used for each device, is broadened to provide a section (7). Thus, the adhesive tape (6) and the connecting wires (100) are adhered as shown in the cross sectional view of FIG. 6. There are many data required for wiring operation, but not yet applied to the connecting wires, such data being, for example, work number, order number, panel number, unit number, block number, device fixing position and device number. It is desirable to print some data of wire distribution (8) required for wiring among these data on the reverse surface of the paper tape (5) near the connecting wires as shown in FIG. 7.

Figure 1:
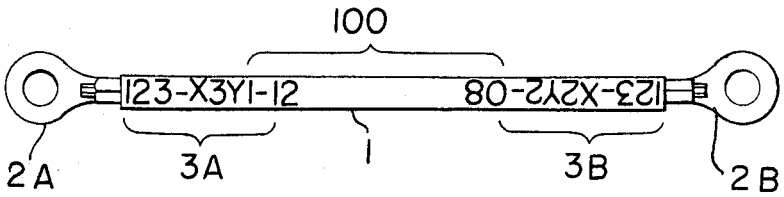
FIG. 1 PRIOR ART
FIG. 1 is a side view showing a typical configuration of a connecting wire used for wiring electric control devices.
Figure 6:
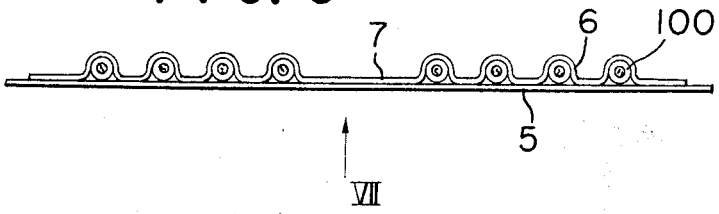
FIG. 6 is a sectional view of the wire harness taken along the line VI—VI of FIG. 5.
Figure 7:
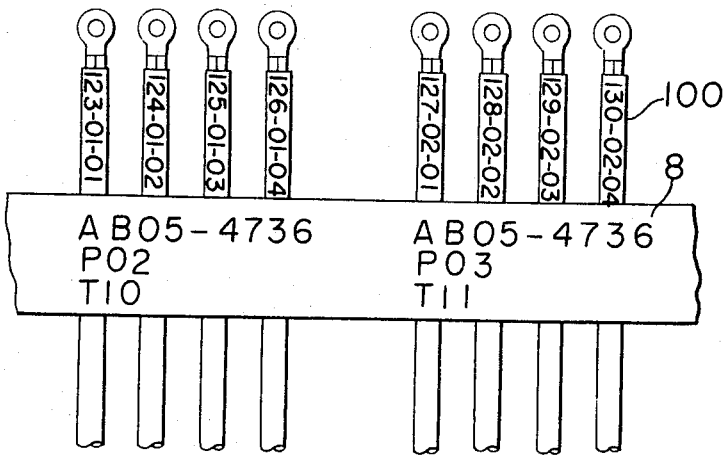
FIG. 7 is a rear view of a part of the wire harness viewed from the arrow direction VII of FIG. 6 which shows a paper tape on which data of wire distribution useful for wiring is printed.

The connecting wires (100) are previously prepared in such a manner that wiring routine and calculation of wire length are processed by a computer to output data whereby the connecting wires are prepared one by one in the wiring order to have the shape as shown in FIG. 1; and the connecting wires are arranged on the paper tape (5) and the adhesive tape (6) is attached to adhesively hold the wires as shown FIGS. 5 through 7. Thus the connecting wires can be used for wiring. It is preferable to place each tape beneath the data of wire distribution (3A), (3B) of the connecting wires. The connecting wires (100) are held at that position by the adhesion of the adhesive tape (6) and arranged regularly in the order of positions of terminals of the device. The connecting wires (100) are to be connected not only to the same device but also to other devices. It is, therefore, desirable that the connecting wires (100) are grouped for connecting to the same device in order to prevent erroneous wiring and to improve wiring efficiency.

In accordance with the present invention, the section (7) producing a sufficiently large interval between adjacent grouped units of the connecting wires is formed so as to clearly show each unit of wiring and to easily allow the breaking of the paper tape (5) and the adhesive tape (6) without a tool. With this breaking, the connecting wires can be easily separated for each unit of wiring thereby improving working efficiency. Data of wire distribution (8) which could not be provided on the connecting wires (100) or are unnecessary after wiring, such data being, for example, work number, order number, panel number, unit number, block number, the name of device, position of device and device number, can be printed on the tape (5) using a computer as shown in FIG. 7. With the data of wire distribution printed on the paper, wiring operators will be able to certainly receive the wire harness even though the connecting wires were prepared at another place and erroneous wiring can be prevented because the operators can easily find the data. Problem of having to read a connection diagram can be eliminated because connection parts are easily found by the data of wire distribution and wiring operation can easily and efficiently be performed even by non-skilled persons.

Figure 8:
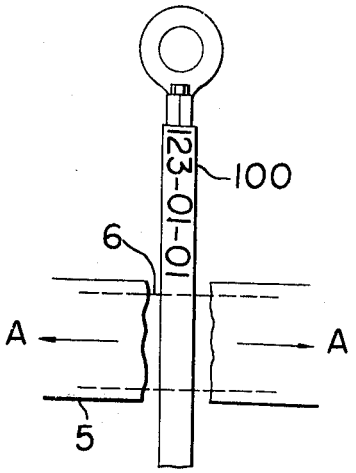
FIGS. 8 and 9 are respectively a front view and a side view illustrating how the connecting wires are removed from the wire harness of the present invention.
Figure 9:
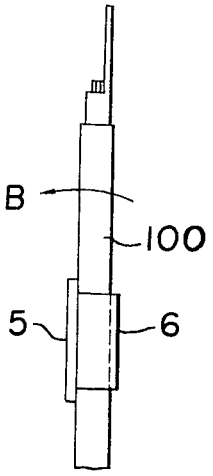

When the paper tape (5) and the adhesive tape (6) become needless before or after wiring, both the tapes (5), (6) are pulled in the direction A as shown in FIG. 8 whereby the paper tape is easily broken and if the connecting wire (100) is taken out in the direction B, the paper tape (5) can be easily separated from the adhesive tape (6) without the remaining of adhesive on the surface of the connecting wire. If the connecting wire (100) is at first pulled in the direction B in FIG. 9, the paper tape is easily broken thereby easily taking out the connecting wire without any tool.

Figure 10:
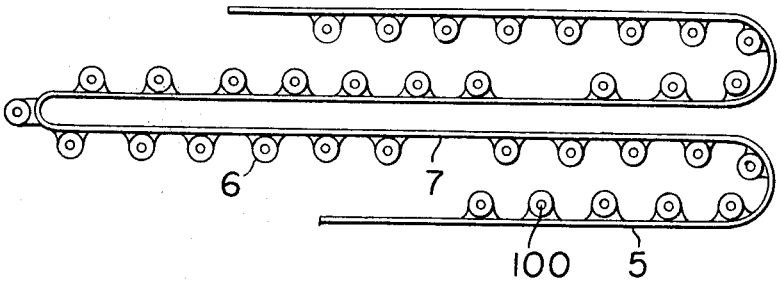
FIG. 10 is an end surface view showing how the wire harness of the present invention is successfully bundled.
Figure 11:
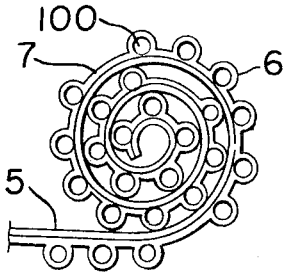
FIG. 11 is an end surface view of the wire harness bundled when the number of connecting wires is smaller.

The connecting wires of the present invention are held side-by-side with certain intervals therebetween so that it is possible to fold a series of the connecting wires into a bundle (FIG. 10) in transportation in the same way as cloth is done. It is possible to use the connecting wire sequentially from the top during the wiring operation thereby permitting efficient working. When the number of the connecting wires is small, it is possible to roll up them by wrapping the paper tape (5) as shown in FIG. 11.

In this embodiment, the paper tape and the adhesive tape are applied at only one position. They can be applied at both ends of the connecting wires and at plural positions with a suitable intervals in the middle portion depending upon the length of the connecting wires. Either of or both the paper tape and the adhesive tape can be substituted for by a material such as yarn, cloth or vinyl-plastic having flexibility as long as it has a sufficient strength to hold the connecting wires and can be easily broken and can be printed on it.

As described above, in accordance with the embodiment of the present invention, any skilled operator who can understand a connection diagram and is well-trained as to determination of the order of wiring operation to the electric apparatuses and devices is not required and even non-skilled persons can be work with high efficiency and without any erroneous wiring operation.

Figure 12:
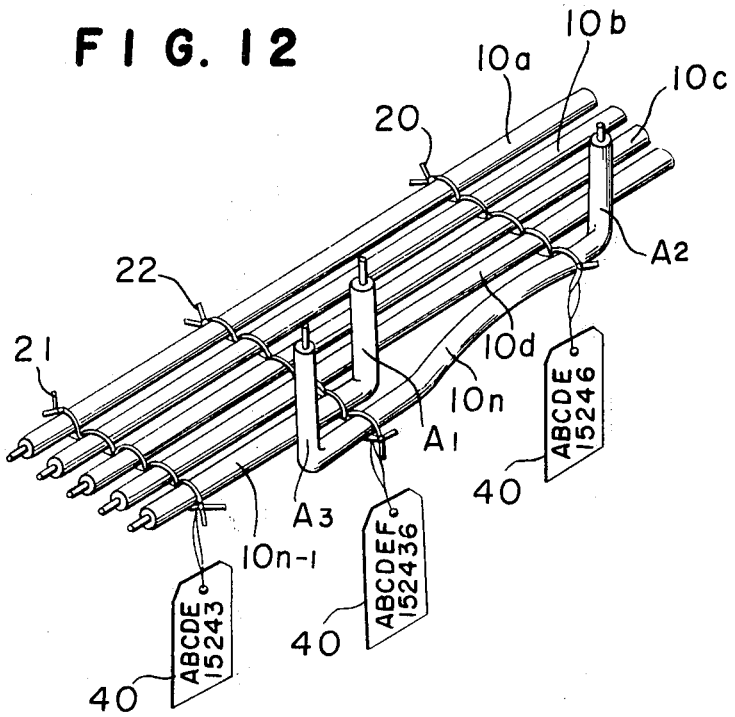
FIG. 12 is a schematic view of another embodiment of the wire harness of the present invention.

Another embodiment of the wire harness of the present invention will be described with reference to the drawings. FIG. 12 is a schematic diagram showing another embodiment wherein the front end and the intermediate end of certain connecting wires are bent at the intermediate portion of other connecting wires and near the fastened portion.

A wire harness shown in FIG. 12 is fabricated as follows: the first connecting wire (10*a*) is prepared; the fastening operation is carried out at three points (20), (21), (22), i.e. the front end, the intermediate portion and the rear end of the connecting wire; the second connecting wire (10*b*) is placed adjacent to the first connecting wire (10*a*) and the fastening is again carried out with a string at the required fastening points (20), (21), (22) as in the first connecting wire (10*a*). In other words, the wire harness is fabricated by fastening a required number of connecting wires (10*a*) to (10*n*) at end portions required, as if a "reed screen" is fabricated. In this case, the fastening is carried out on the connecting wires (10*a*) to (10*n*), having variable length, from the front end to the intermediate end, from the intermediate end to the rear end and between the intermediate ends.

As shown in FIG. 12, the fastening operations to the connecting wires (10*a*) to (10*d*) at the points (20), (21), (22) are the same as that of the connecting wire (10*a*). On the other hand, when a connecting wire (10*n*−1), which has an upright portion ($A_1$) formed by bending its one end upwards in an L-shape depending upon the location of a device to which the connecting wire is connected, is fastened, the fastening is carried out at the point (22) near the upright portion ($A_1$) and also at the point (21) near the front end.

When a connecting wire (10*n*), which has upright portions ($A_2$), ($A_3$) formed by bending both ends of the connecting wire upwards so as to be in a "channel" shape, is fastened, the fastening is carried out at the fastening point (20) near the upright portion ($A_2$) as with the connecting wires (10*a*) to (10*d*). The upright portion ($A_3$) is placed near the upright portion ($A_1$) of the connecting wire (10*n*−1) and the fastening is carried out at the fastening point (22) as with the connecting wires (10*a*) to (10*n*−1).

Thus, the connecting wires (10*a*) to (10*n*) have their bent portions formed according to requirement of objects to which the connecting wires are connected; and the locations of the objects and also the fastening points can be varied as desired.

When the fastening operations of the connecting wires (10*a*) to (10*n*) have been carried out at the fastening points (20), (21), (22) as described above, cards (40) in which requisite information is shown are attached at the fastening points (20), (21), (22).

Figure 13:
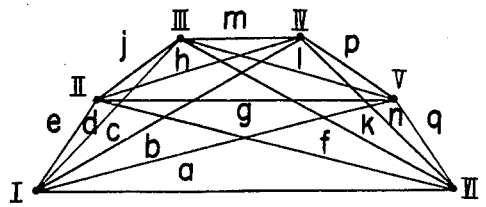
FIG. 13 is a diagram showing total wiring paths at six points of the wire harness of the present invention.

If a harness is fabricated to wire to six devices located in different positions, it is necessary to use fifteen wires for wiring paths (a) to (q) as shown in FIG. 13 in which the reference numeral I designates a front end, VI a rear end and II to V intermediate ends of the harness respectively.

Figure 14:
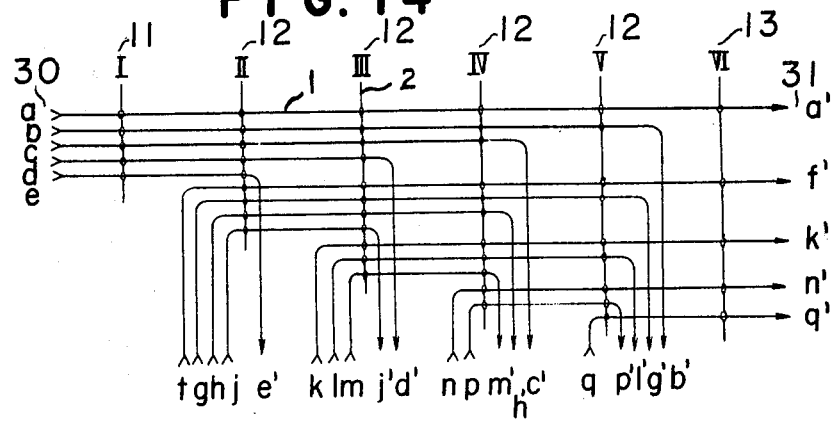
FIG. 14 is a developed view of the total wiring paths of FIG. 13.

FIG. 14 is a diagram shown by rewriting a total wiring system of FIG. 13 in accordance with the system of the present invention, that is, FIG. 14 is a developed view of the wiring system of FIG. 13. In FIG. 14, the reference numeral (11) designates the front end, (12) the intermediate ends and (13) the rear end of the harness respectively. The front end (11) of the harness in FIG. 14 is the same as the front end (I) of the harness in FIG. 13 and the rear end (13) of the harness in FIG. 14 is the same as the rear end (VI) of the harness in FIG. 13. Similarly, the intermediate ends (12) of the harness in FIG. 14 are the same as the intermediate ends (II) to (V) of the harness in FIG. 13. The reference numeral (30) designates the front end of the connecting wire; (31) designates the rear end and the characters (a) to (q) designate wiring paths with their respective ends (a') to (q').

In FIG. 14, the fastening points, i.e. the portions of the front end (11), the intermediate ends (12) and the rear end (13) correspond to the positions of each device (not shown) and are the end portions of the harness which count (n−1) numbers of the connecting wires wherein n is the number of the device.

Figure 15:
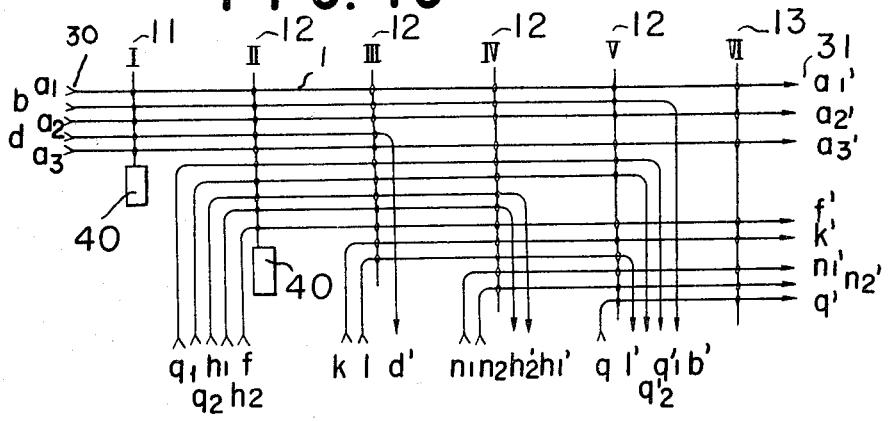
FIG. 15 is a developed view of another typical way of the total wiring paths of the wire harness of the present invention.

In practical wiring, it is not always necessary to arrange the connecting wires in all wiring paths depending upon the function of the wiring and kind of the devices. On the other hand, it is necessary to arrange a plurality of the connecting wires in a wiring path. FIG. 15 shows an embodiment of the wiring as described above, in which the same reference numerals designate the same parts.

In the wire harness of this embodiment, the connecting wires are regularly arranged (in the x direction) and the positions of each ends (orientated in the y direction) can easily be found so that point where each end is to be connected is so clear as to highly improve the productivity.

If the number of the connecting wires is large or the length of the wire harness is great, the cards (40) on which information on each connecting wire placed side-by-side is shown are used as shown in the example of FIG. 12 whereby the connection of the end of each connecting wire (10*a*) to (10*n*) is made clear and in addition, the reading of wiring diagram is not needed.

In the wire harness of this embodiment the connecting wires are fastened with a string one by one whereby the shift of position and the tangle of the connecting wires can be reduced and the connecting wires are arranged that so that machines are suitably employed for the preparation.

In the wire harness of the present invention, connecting wires having different kind, length and number are arranged in a predetermined order which is kept unchanged. Accordingly, it is possible to prepare it according to program and an automatic system can be employed. Various kinds of wire harnesses can be easily fabricated by employing a computer for which the programming is modified. In addition, information can be printed on the cards (40) according to an automatic system.

In the embodiment described above, the connecting wires are fastened with the string one by one. However, the fastening according to the present invention includes a single-ring stitching, a double-ring stitching as in a machine sewing or a way like a knitting. The effect obtained by these ways is the same with that of the embodiment described above. The same effect can be obtained by fastening or knitting the connecting wires with a band of smaller width instead of the string. It is also effective to fasten with the string and so on portions besides the front end, the rear end and the intermediate end, for example, an intermediate portion remote from the fastening points.

In accordance with the wire harness of this embodiment, a plurality of connecting wires to be connected with different devices are placed in order; and the front end portion, the intermediate end portion and the rear end portion which correspond to the position of each device are fastened by a binding member such as a string so as to form a flat structure so that the fastened points at the each end portion of the connecting wire are easily released in the order of wiring. Accordingly, the wiring operation can be easily carried out to improve productivity and the having to read the wiring diagram can be needless by the use of the cards.

The flat structure of the wire harness facilitates employment of machines and use of a computer allows a full automatic system. The wire harness of this embodiment, when bundled, gives the advantage of its having the same occupied sectional area as the conventional wire harness.

Figure 16:
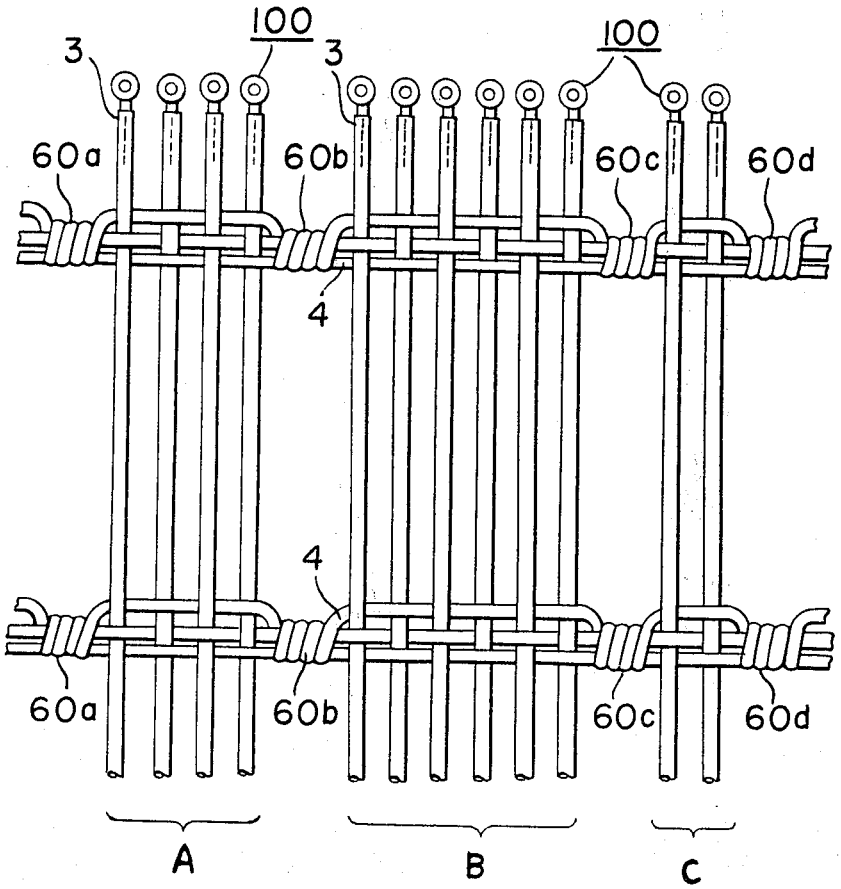
FIG. 16 is further embodiment of the wire harness of the present invention.

Further embodiments of the wire harness of the present invention will be described with reference to the drawings. FIG. 16 is a plan view of one embodiment of the invention, wherein the reference numeral (100) designates connecting wires which are prepared by the same manner as with FIG. 1.

The connecting wires (100) are, as shown in FIG. 16, fastened so as to keep a flat arrangement of the connecting wires by binding members (4) independent of each other and are separable at sections (60*a*) to (60*d*) which form boundaries for each device in the wiring.

A series of the connecting wires (100) fastened in the shape as shown in FIG. 16 is bundled to feed the next process. FIG. 17 is a cross sectional view of the connecting wires bundled in a spiral shape.

Figure 2:
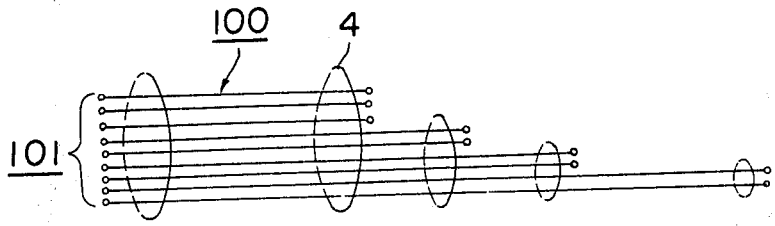
FIG. 2 PRIOR ART
FIG. 2 is a schematic view of the conventional wire harness fabricated with the connecting wires shown in FIG. 1 with which operators perform wiring.
Figure 3:
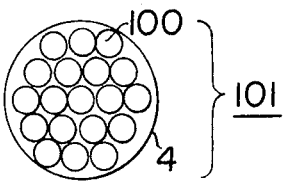
FIG. 3 PRIOR ART
FIG. 3 is a cross sectional view of the wire harness shown in FIG. 2.
Figure 4:
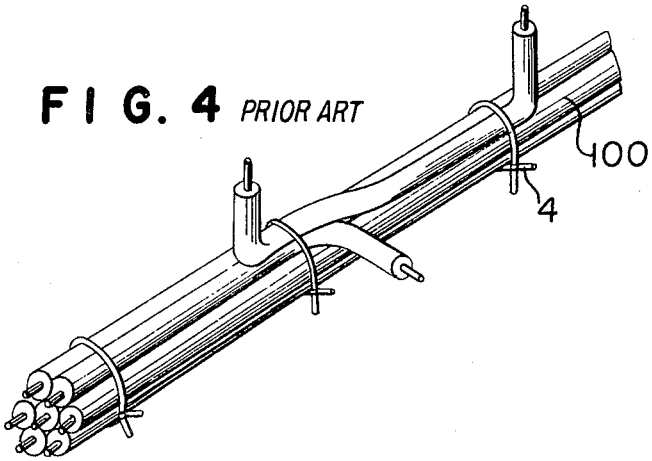
FIG. 4 PRIOR ART
FIG. 4 is a schematic view of another embodiment of the conventional harness.

When the length of the connecting wires is small, they can be carried as they are as shown in FIG. 2, whereas when large, the connecting wires (100) are wound into the shape as shown in FIGS. 19*a* and 19*b*, that is, the connecting wires are rolled in a spiral form from the top ends (solderless terminal side) or the bottom side in FIG. 16.

When the number of the connecting wires (100) is large and the connecting wires are bundled into the shape as shown in FIG. 17, that is, the connecting wires are rolled up from the left side or the right side of FIG. 16 so as to give the longitudinal direction of the connecting wires (100) axial center, the diameter becomes large. In such a case, the connecting wires are zigzagged to put one on the other into a flat-cable shape as shown in FIG. 18 and then they are rolled up as shown in FIG. 19*b*.

As is clear from the foregoing description, the wire harness of the present invention, fastened in the shape shown in FIG. 16, has its connecting wires (100) each being prepared in the order of wiring to the devices and being fastened by the binding members (4) one by one. The connecting wires are fastened at portions more than two depending upon the length of the wires and are bundled into a flat cable and the sections defining each unit (60*a*) to (60*d*) are fastened by the same binding member (4) to keep regular arrangement of the connecting wires (100) as shown in FIG. 16. If the connecting wires (100) to be connected to a device named "X" (not shown) are the connecting wires (100) placed in the range of "A" in FIG. 16, the wiring is carried out as follows: each central portion of the sections (60*a*) and (60*b*) is cut and the connecting wires (100) thus separated are brought to the device "X" to which the wires are connected and the connection is made with the connecting points between the connecting wires (100) and the device "X" in accordance with the wiring information card (3) which is printed in or attached to the connecting wires (100), the connection being easily done because the connecting wires (100) are arranged in the order of the wiring to the device "X". With this structure, the necessity of finding the connecting wires (100) in the order of the wiring is eliminated to remarkably reduce the working time for the wiring.

The section (60*a*) is left as it is and a binding member traversing the center is pulled out whereby the other binding members can be removed into a container.

After the wiring operation to the device "X" has been finished, the same operation can be started on the next device named "Y" (not shown) by cutting the central portion of the section (60*c*). Thus, the order of wiring to various devices is made clear and the effect is remarkably high. The order of wiring to the devices and the arrangement of the connecting wires for each device are processed by the computer which operates an automatic machine for the connecting wire to continuously prepare the wires.

When the number of the connecting wires (100) to be connected to a single device is small and the number of devices to be mounted on one unit is small, the wire harness is firstly made into the shape of FIG. 16 and then is rolled up into the shape of FIG. 17 or FIG. 19*a* so as to feed it to wiring operators in the next step. However, when the number of the connecting wires (100) for a single device is large, the wire harness is shaped up into the shape of FIG. 18 or FIG. 19*b* to feed it to wiring operators so that easy wiring operation can be attained by sequentially wiring the connecting wires (100) from the top of them in FIG. 18. It is possible to bundle the connecting wires as shown in FIG. 18 because the connecting wires (100) are fastened like a reed screen as shown in FIG. 16.

In this embodiment, three binding members are used for one fastening point. Two or more binding members can be used for one fastening point when the number of the fastening points is more than two.

The binding member (4) can be circular in cross section but is not limited to use any material and cross sectional shape as long as it has a string-like configuration made of flexible, electrically insulating material.

In this embodiment, the fastening points are provided by knitting several binding members to show marks for the sections and to prevent the releasing of the connecting wires. It is possible to use any other kind of binding members, adhesive tapes, clips made of plastic resin, a binding member (4) coated with thermosettable adhesive or a binding member (4) made of heat-adhesive material to which heat is applied to bond it together.

As described above, in accordance with the wire harness of this embodiment, the connecting wires to be connected between separate devices in electric control panels, distribution panels and distribution boxes, are cut in a previous process in predetermined length depending upon kind, size and color; data of wire distribution such as line number are printed at both ends of the connecting wires; solderless terminals are attached to both the ends; the connecting wires are arranged in the order of wiring; and indications are provided for each group of the connecting wires for each device to allow easily cutting at those portions. Accordingly, it is unnecessary to find a requisite connecting wire during the wiring operation and to be concerned with the order of wiring; and operators can easily find the data of wiring distribution printed at both the ends of the connecting wires because they are arranged flat so that even non-skilled persons can perform wiring operations efficiently and with less errors.

The wire harness does not cause any tangle of the connecting wires and provides easy transportation because the connecting wires are fastened independent of each other. Any problem is not caused by use of the binding member because of its being made of electrically insulating material although the binding member can be easily removed if unnecessary. Rather, the connecting wires fastened in a harness structure eliminates the bundling operation and allows easy handling after wiring.

INDUSTRIAL APPLICABILITY

The present invention can be applied not only to the wire harness connected to electric control apparatuses and devices but also electric apparatuses and devices to which wiring is to be carried out.

We claim:

1. A wire harness comprising:

a plurality of connecting wires with each said wire being provided with terminals on each end and wherein said connecting wires are used for wiring electrical control devices;

a paper tape on which each of said wires is placed side-by-side and independent of each other with a space therebetween;

an adhesive tape adhering to said paper tape and covering the connecting wires on the side opposite said paper tape in order to hold said connecting wires on said paper tape, wherein said connecting wires are divided into a plurality of sections corresponding to a unit of wiring for each section wherein the spacing between sections is larger than the spacing between each of said wires in each section so that each unit of wiring may be easily separated manually from each of the other units by breaking said paper and adhesive tape between said sections and wherein the spacing between said wires is such that said harness is capable of being folded together for transportation;

wherein data for each connecting wire is printed on the surface opposite said wires of said paper tape; and wherein said adhesive tape and said paper tape may be easily separated manually in order to easily remove the respective connecting wires.

2. The wire harness according to claim 1 wherein said paper tape and said adhesive tape is made of a material having a sufficient strength to hold said connecting wires.

* * * * *